US009533401B2

(12) United States Patent
Lin

(10) Patent No.: US 9,533,401 B2
(45) Date of Patent: Jan. 3, 2017

(54) RATCHET DRIVING MECHANISM FOR HAND TOOL

(71) Applicant: Yih Cheng Factory Co., Ltd, Nantuo (TW)

(72) Inventor: Jack Lin, Nantuo (TW)

(73) Assignee: YIH CHENG FACTORY CO., LTD, Nantuo (TW)

( * ) Notice: Subject to any disclaimer, the term of this patent is extended or adjusted under 35 U.S.C. 154(b) by 324 days.

(21) Appl. No.: 14/272,282

(22) Filed: May 7, 2014

(65) Prior Publication Data

US 2015/0321323 A1 Nov. 12, 2015

(51) Int. Cl.
*B24B 15/04* (2006.01)
*B25B 15/04* (2006.01)
*B25B 13/46* (2006.01)

(52) U.S. Cl.
CPC ..... *B25B 15/04* (2013.01); *B25B 13/462* (2013.01); *B25B 13/465* (2013.01); *B25B 13/468* (2013.01)

(58) Field of Classification Search
CPC ..... B25B 13/463; B25B 15/04; B25B 13/465; B25B 13/468; B25B 13/462
See application file for complete search history.

(56) References Cited

U.S. PATENT DOCUMENTS 6,047,802 A * 4/2000 Huang ..... B25B 13/465 192/43.2
7,237,459 B1 * 7/2007 Shiao ..... B25B 13/465 81/62
2007/0243763 A1 * 10/2007 Hu ..... B25B 13/465 439/607.01

* cited by examiner

*Primary Examiner* — Robert Scruggs
(74) *Attorney, Agent, or Firm* — Chun-Ming Shih; HDLS IPR Services

(57) ABSTRACT

A ratchet driving mechanism for a hand tool includes: a drive unit, including a drive shaft, a position member and a plurality of latch members, wherein each of the latch members includes a latch plate and an elastic piece; an adjustment ring, sleeved on the drive shaft and formed with a plurality of cavities allowing the position member to be selectively latched and positioned and an accommodation slot allowing each of the latch plates to inwardly/outwardly move; and a ratchet unit, sleeved on the drive shaft and formed with a plurality of ratchet teeth allowing each of the latch plates to be engaged. Accordingly, during the drive shaft driving the ratchet unit for generating rotation, the position member is able to precisely position the ratchet unit on drive shaft.

9 Claims, 13 Drawing Sheets

RATCHET DRIVING MECHANISM FOR HAND TOOL

BACKGROUND OF THE INVENTION

Field of the Invention

The present invention relates to a ratchet driving mechanism, especially to a ratchet driving mechanism for a hand tool.

Description of Related Art

A conventional screwdriver is composed of a rod member being combined with a handgrip and used for rotating a fasten member (such as a screw) for the purpose of combination. For providing more conveniences in use, various types of ratchet driving mechanisms have been developed for controlling the direction in which the screwdriver is driven, so the fasten member (such as a screw) is able to be easily rotated.

However, the ratchet driving mechanisms are all provided with two thin plate members for being engaged with a gear composed of a plurality of ratchet teeth, the thin plate member only utilizes an edge for being mutually engaged with the ratchet teeth, so the thin plate member is unable to sustain a larger torque, in other words the user cannot apply a large torque or the plate member would be very likely to be damaged. During the plate member being engaged with the ratchet teeth, a position member and an adjustment ring are provided for the purpose of position limiting; when a torque is applied for rotation, the adjustment ring is very likely to be recovered or slid due to the friction force, so the position member would be released from a position hole thereby causing imprecise positioning, and the screwdriver is unable to be normally operated.

SUMMARY OF THE INVENTION

The present invention is to provide a ratchet driving mechanism for a hand tool, wherein during a drive shaft driving a ratchet unit for generating rotation, a position member is able to precisely position the ratchet unit on drive shaft.

Accordingly, the present invention provides a ratchet driving mechanism for a hand tool, which includes a drive unit, an adjustment ring and a ratchet unit. The drive unit includes a drive shaft, a position member and a plurality of latch members, the position member and each of the latch members are installed on the drive shaft, and each of the latch members includes a latch plate and an elastic piece provided between the drive shaft and the latch plate. The adjustment ring is sleeved on the drive shaft corresponding to the position member and a portion of each of the latch members, and the adjustment ring is formed with a plurality of cavities allowing the position member to be selectively latched and positioned and an accommodation slot allowing each of the latch plates to inwardly/outwardly move. The ratchet unit is sleeved on the drive shaft corresponding to another part of each of the latch members, and the ratchet unit is formed with a plurality of ratchet teeth allowing each of the latch plates to be engaged.

In comparison with related art, the present invention has advantageous features as follows. Because the rotating and positioning direction of the adjustment ring is the same as the rotating direction in which the drive shaft drives the ratchet unit, a ball of the position member is prevented from being released from the cavity during the rotating operation, thereby ensuring the positioning stability. The structure is simplified so the assembling and maintaining process would become easier and time efficient.

DETAILED DESCRIPTION OF THE INVENTION

A preferred embodiment of the present invention will be described with reference to the drawings.

Figure 1:
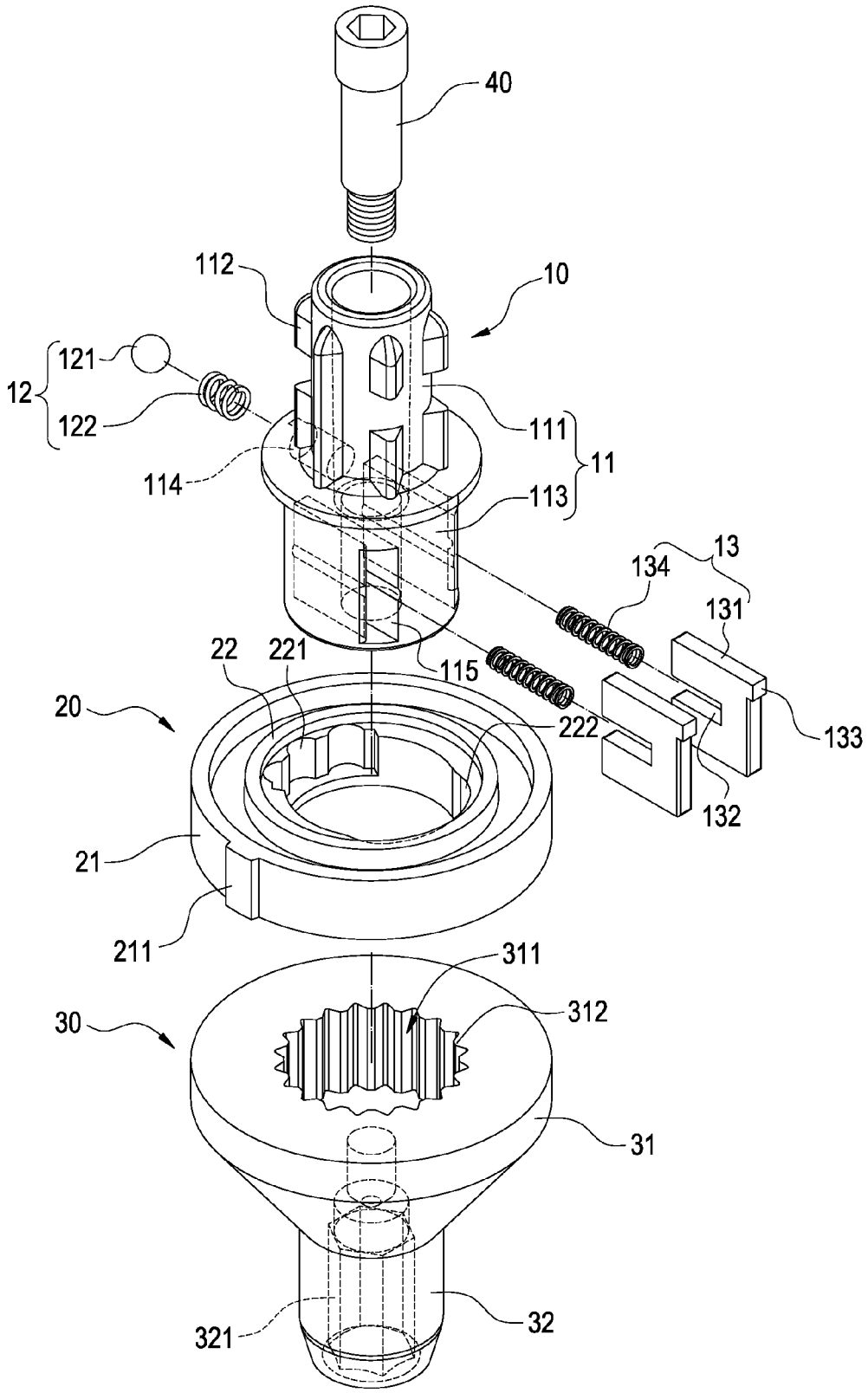
FIG. 1 is an exploded view showing the ratchet driving mechanism according to the present invention.
Figure 2:
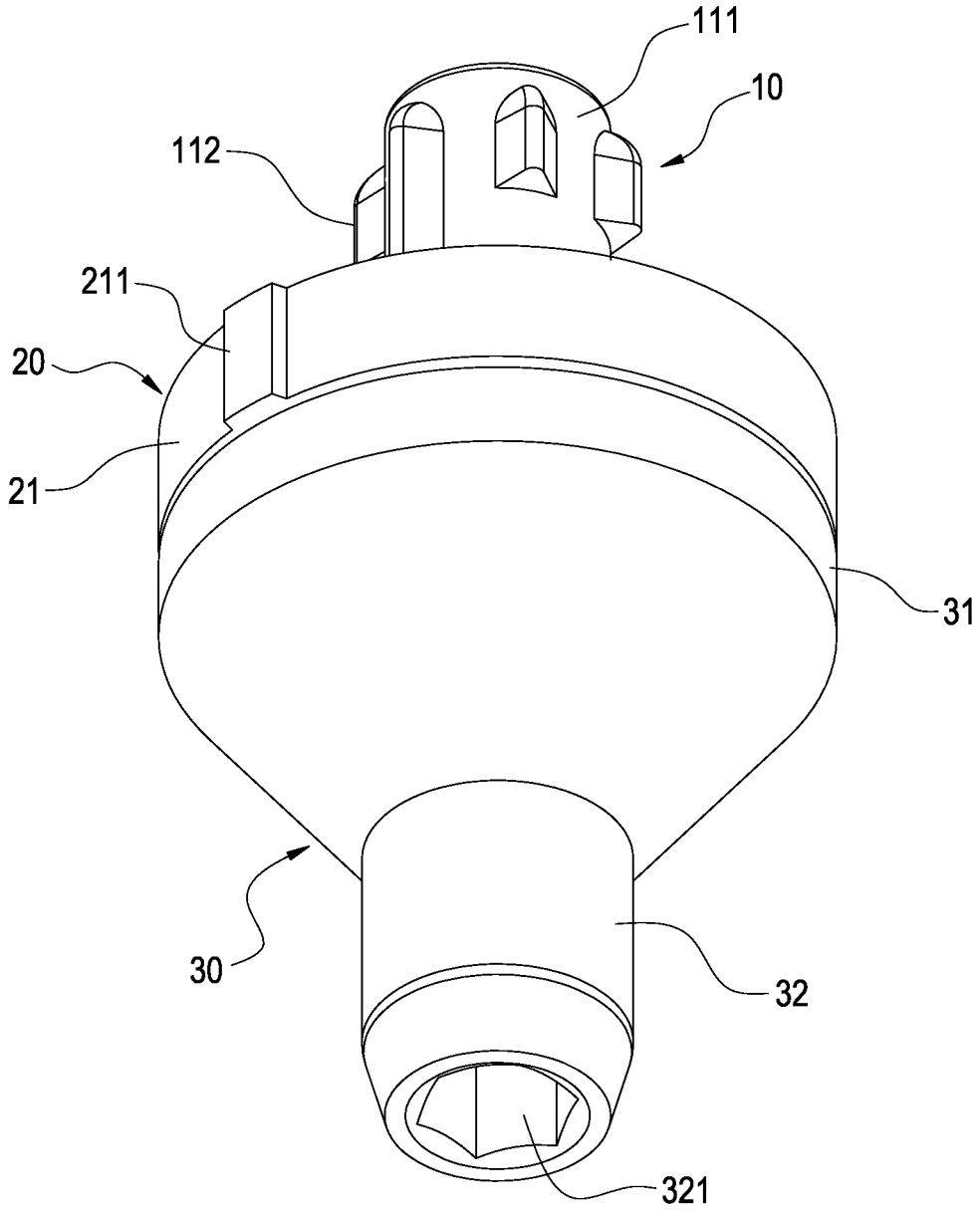
FIG. 2 is a schematic view showing the assembly of the ratchet driving mechanism according to the present invention.
Figure 3:
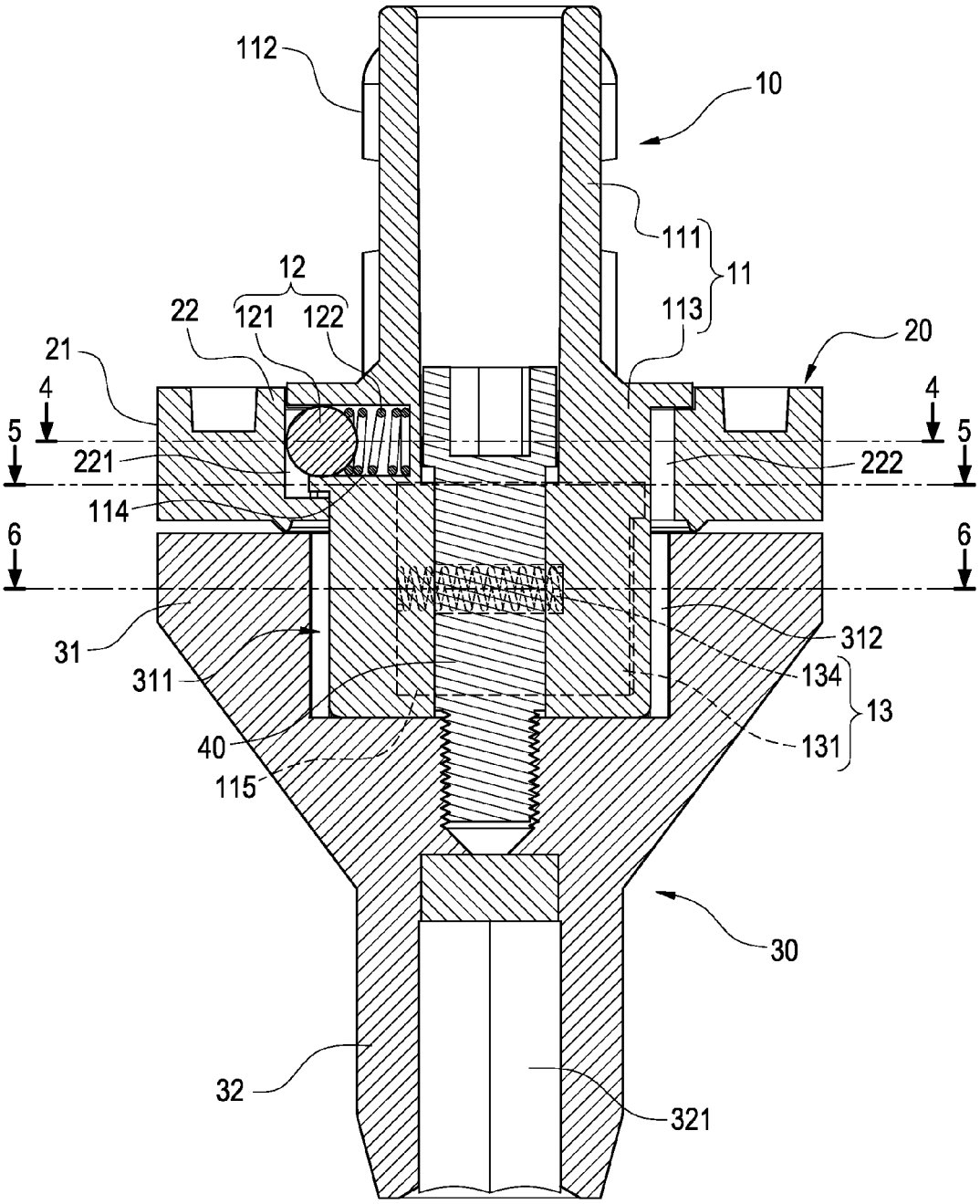
FIG. 3 is a cross sectional view showing the assembly of the ratchet driving mechanism according to the present invention.

Please refer to FIG. 1 to FIG. 3, the present invention provides a ratchet driving mechanism for a hand tool, which mainly includes a drive unit 10, an adjustment ring 20 and a ratchet unit 30.

The drive unit 10 includes a drive shaft 11, a position member 12 and a plurality of latch members 13. The drive shaft 11 is formed with a fasten segment 111 and a rotation segment 113 axially extended along the fasten segment 111. The fasten segment 111 is formed as a hollow column, and the outer surface thereof is protruded with a plurality of longitudinal ribs 112. The rotation segment 113 is also formed as a hollow column, and an end section thereof close to the fasten segment 111 is formed with a blind hole 114, the portion of the rotation segment 113 defined as opposite to the blind hole 114 is formed with two insertion slots 115, the two insertion slots 115 are in parallel with each other and arranged with an interval. According to this embodiment, the insertion slot 115 is formed in a rectangular shape, but what shall be addressed is that the scope of the present invention is not limited to the certain shape of the insertion slot.

The position member 12 mainly includes a ball 121 and a compress spring 122, the ball 121 and the compress spring 122 are received in the blind hole 114, and the compress spring 122 is served to push the ball 121 to move towards the outer side of the blind hole 114.

Each of the latch members 13 is respectively received in the insertion slots 115, and the latch member 13 includes a latch plate 131 and an elastic piece 134. The latch plate 131 is substantially formed in a U-like shape, and the middle portion thereof is formed with a groove 132, the top closed end of the latch plate 131 is protruded with an abutting block 133. The elastic piece 134 can be formed as a spiral compress spring which is received in the groove 132 of the latch plate 131 and served to push the latch plate 131 to move towards the outer side of the insertion slot 115.

The adjustment ring 20 is formed as a hollow circular ring, and sleeved on the drive shaft 11 corresponding to the position member 12 and the upper portion of each of the latch members 13. The adjustment ring 20 is formed with an outer annular piece 21 and an inner annular piece 22 formed at the inner side of the outer annular piece 21, a surface of the outer annular piece 21 is outwardly extended with a convex strip 211, the inner periphery of the inner annular piece 22 is formed with three cavities 221, and an accommodation slot 222 is formed in an area opposite to each of the cavities 221, wherein the ball 121 of the position member 12 is enabled to elastically abut through the compress spring 122, the ball 121 is able to be selectively latched and positioned in one of the cavities 221. The latch plate 131 is enabled to elastically abut through the elastic piece 134 thereby allowing the abutting block 133 to perform an inward/outward movement relative to the accommodation slot 222.

The ratchet unit 30 is sleeved on the drive shaft 11 corresponding to the lower portion of each of the latch members 13 and mutually stacked with the adjustment ring 20. The ratchet unit 30 is formed with a head part 31 and a neck part 32 axially extended from the head part 31. The middle portion of the head part 31 is formed with a central hole 311, and the inner wall of the central hole 311 is annularly formed with a plurality of ratchet teeth 312, each of the ratchet teeth 312 allows the lower portion of each of the latch plates 131 to be engaged for the purpose of driving. The center of the neck part 32 is formed with a hexagonal insertion hole 321 allowing a screwdriver head (not shown in figures) to be inserted therein.

Figure 4:
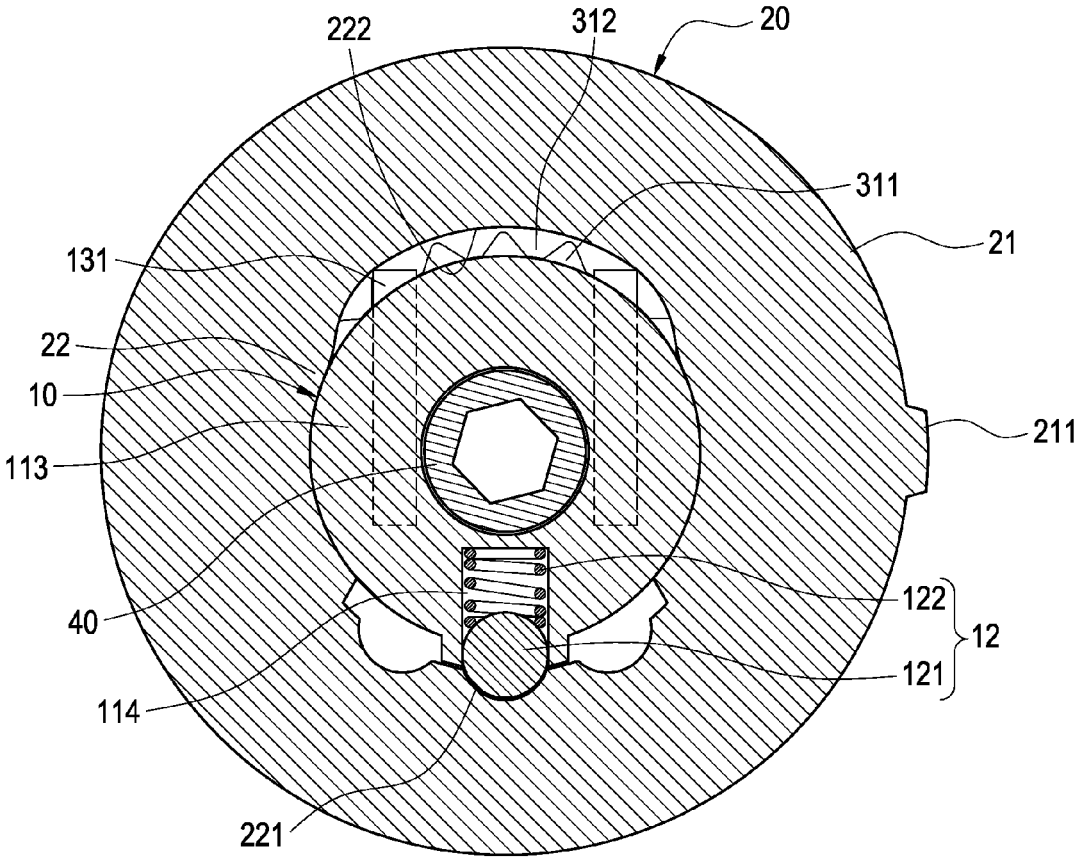
FIG. 4 is a cross sectional view of FIG. 3 taken alone line 4-4.
Figure 5:
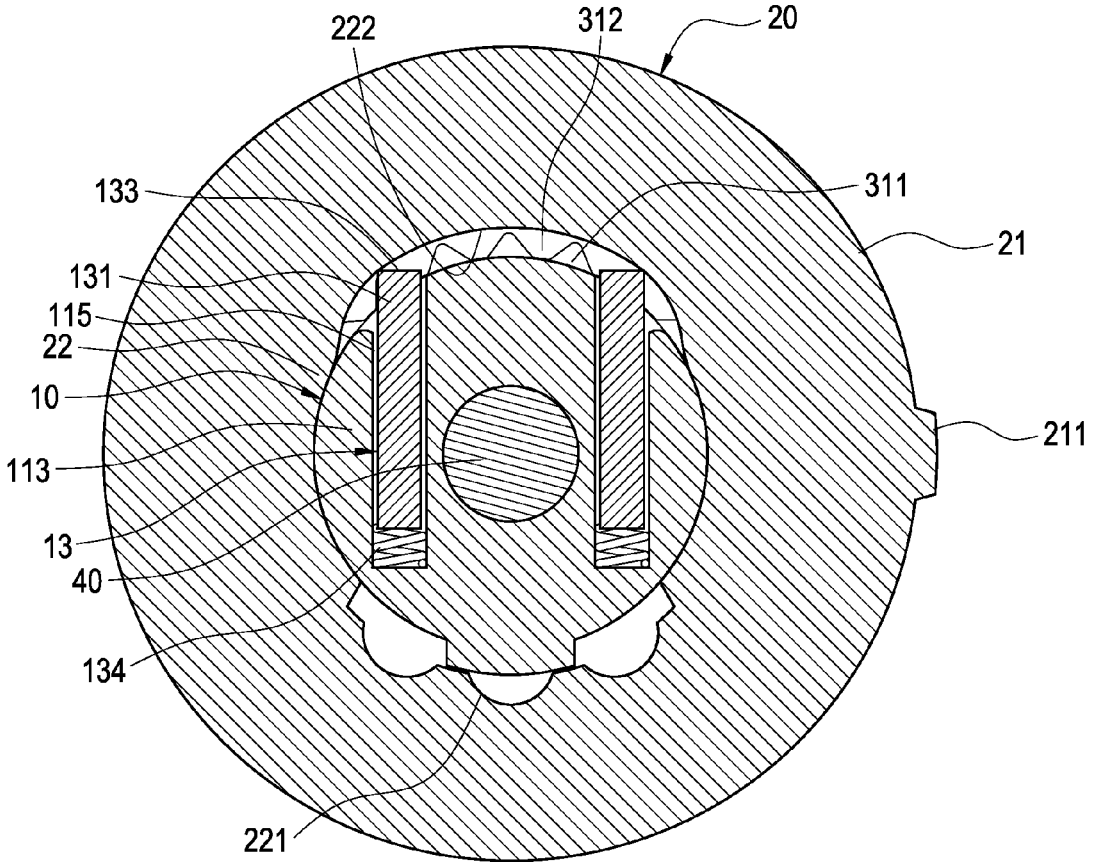
FIG. 5 is a cross sectional view of FIG. 3 taken alone line 5-5.
Figure 6:
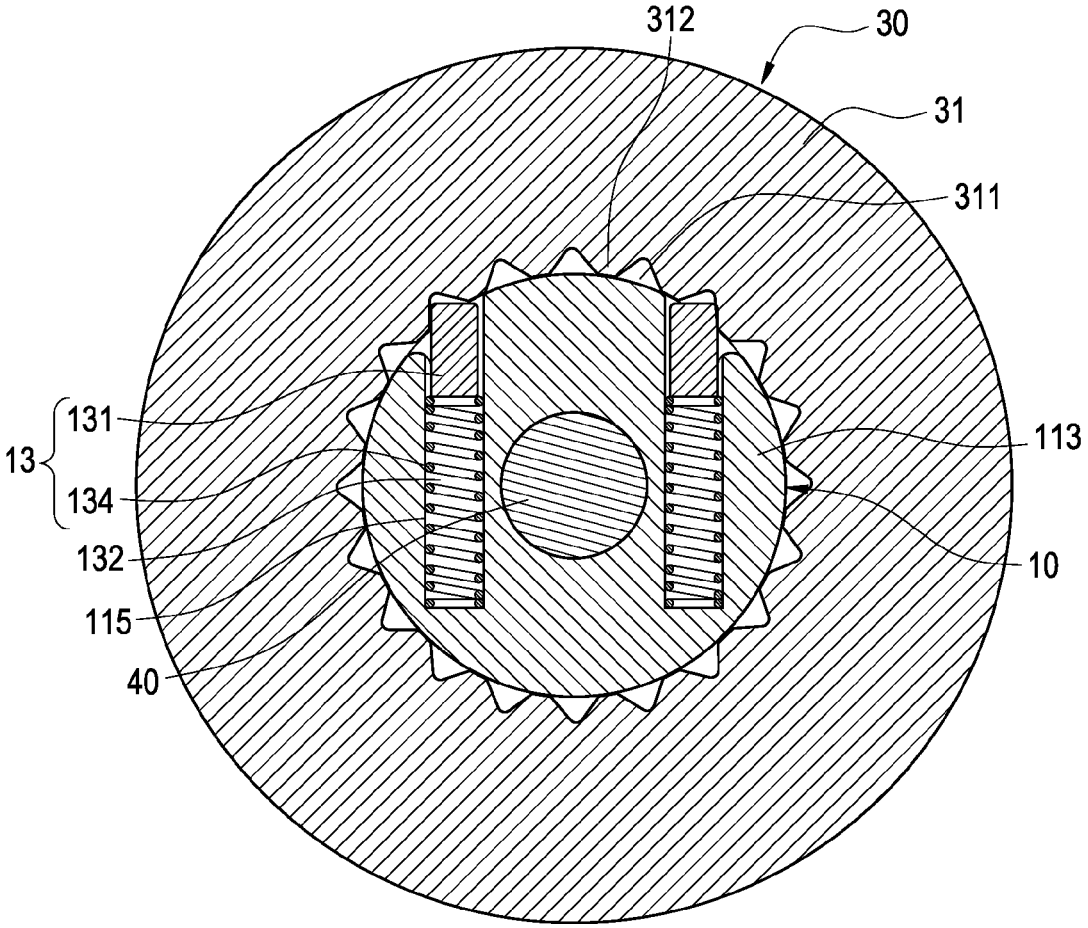
FIG. 6 is a cross sectional view of FIG. 3 taken alone line 6-6.
Figure 7:
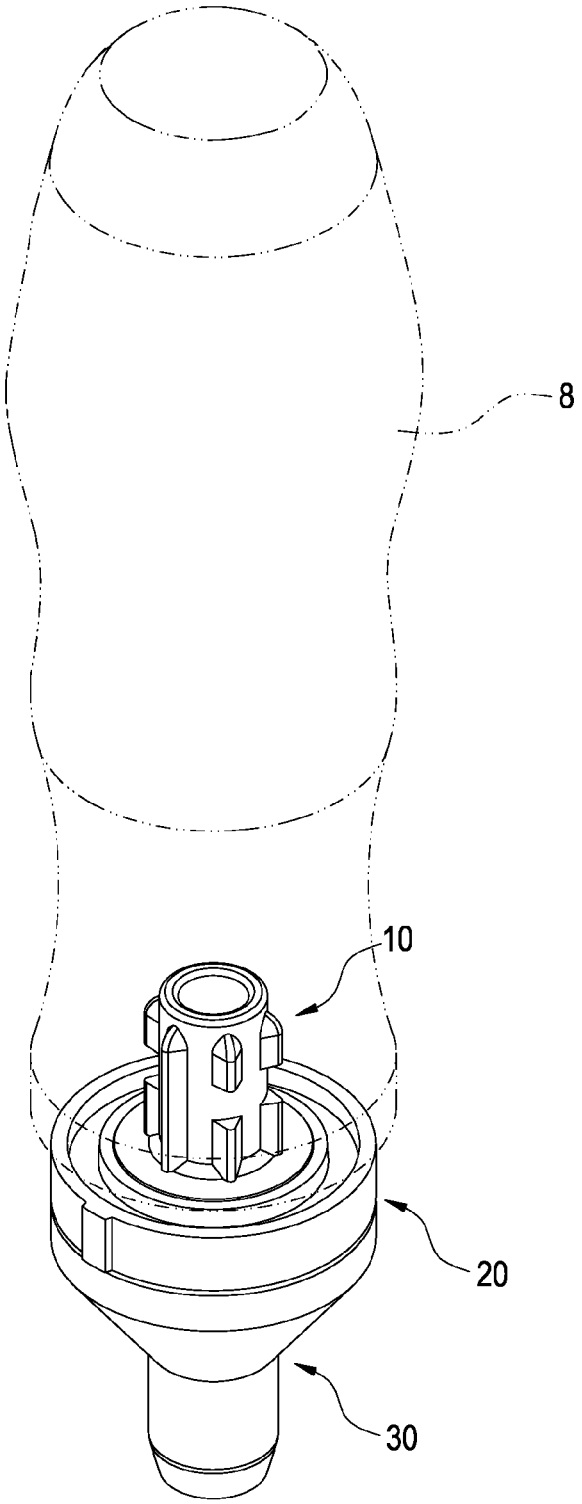
FIG. 7 is a schematic view showing the ratchet driving mechanism being applied in a hand tool.

Please refer from FIG. 4 to FIG. 6, in assembly, the position member 12 and each of the latch members 13 are respectively disposed in the blind hole 114 of the rotation segment 113 and each of the insertion slots 115, then the adjustment ring 20 is sleeved on the rotation segment 113, thereby allowing the ball 121 to be pushed by the compress spring 122 for being latched in the cavity 221 defined in the middle (as shown in FIG. 4). Each of the latch plates 113 is pushed by the elastic piece 134 thereby allowing all the abutting blocks 113 to be accommodated in accommodation slot 222, and the abutting blocks 133 are enabled to elastically abut against the inner wall of the accommodation slot 222 (as shown in FIG. 5). The lower portion of the rotation segment 113 is disposed in the central hole 311 of the ratchet unit 30, and the lower portion of each of the latch plates 131 is mutually latched with the ratchet teeth 312 through the latch plate 131 being pushed by the elastic piece 134 (as shown in FIG. 6). Lastly, a screw unit 40 is provided for sequentially passing the fasten segment 111 and the rotation segment 113 then secured in a screw hole formed on the ratchet unit 30 so as to be combined (as shown in FIG. 3). Accordingly, a ratchet driving mechanism is assembled.

When ball 121 is positioned in the cavity 221 defined in the middle, no matter the rotation segment 113 is rotated clockwise or counterclockwise, the ratchet unit 30 can be driven through the lower portion of the latch plate 131 being mutually latched with the ratchet teeth 312 for driving the screwdriver head to be operated clockwise or counterclockwise.

Figure 8:
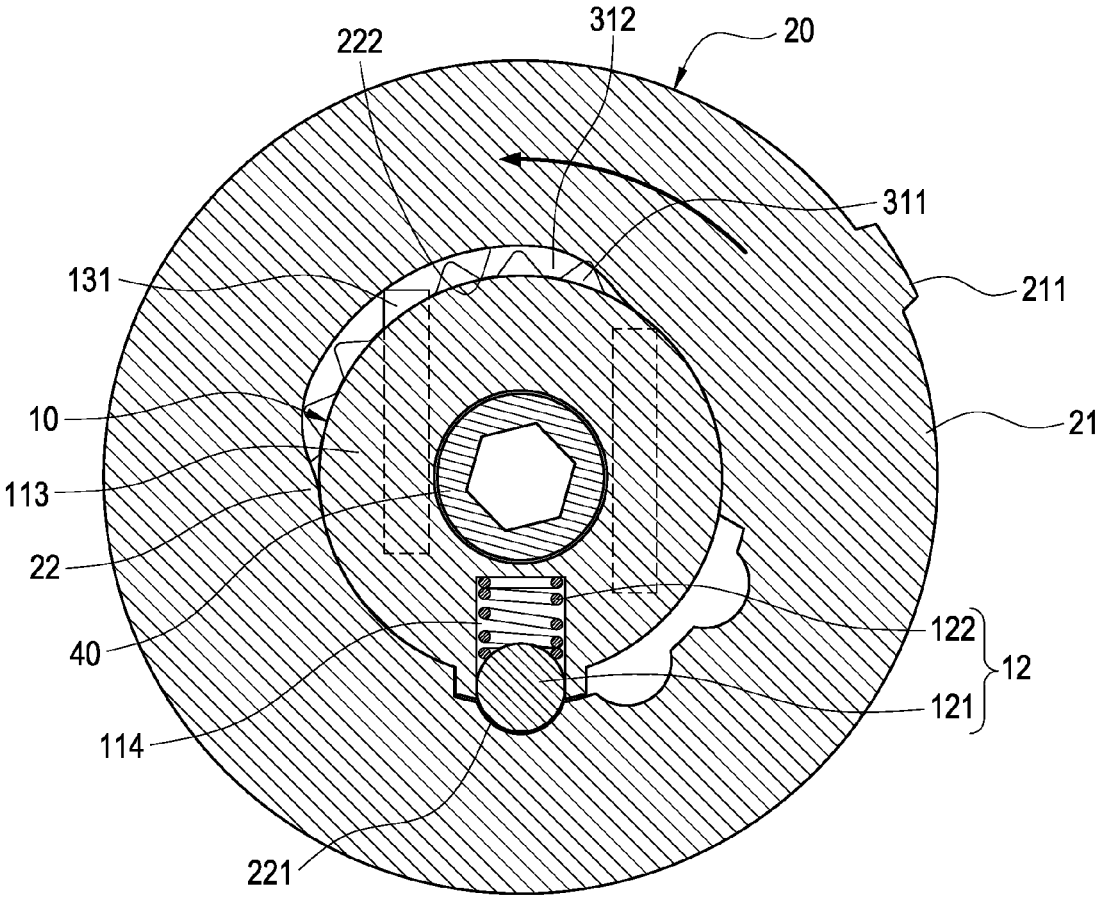
FIG. 8 is a cross sectional view showing the operation status after the adjustment ring being rotated counterclockwise according to the present invention.
Figure 9:
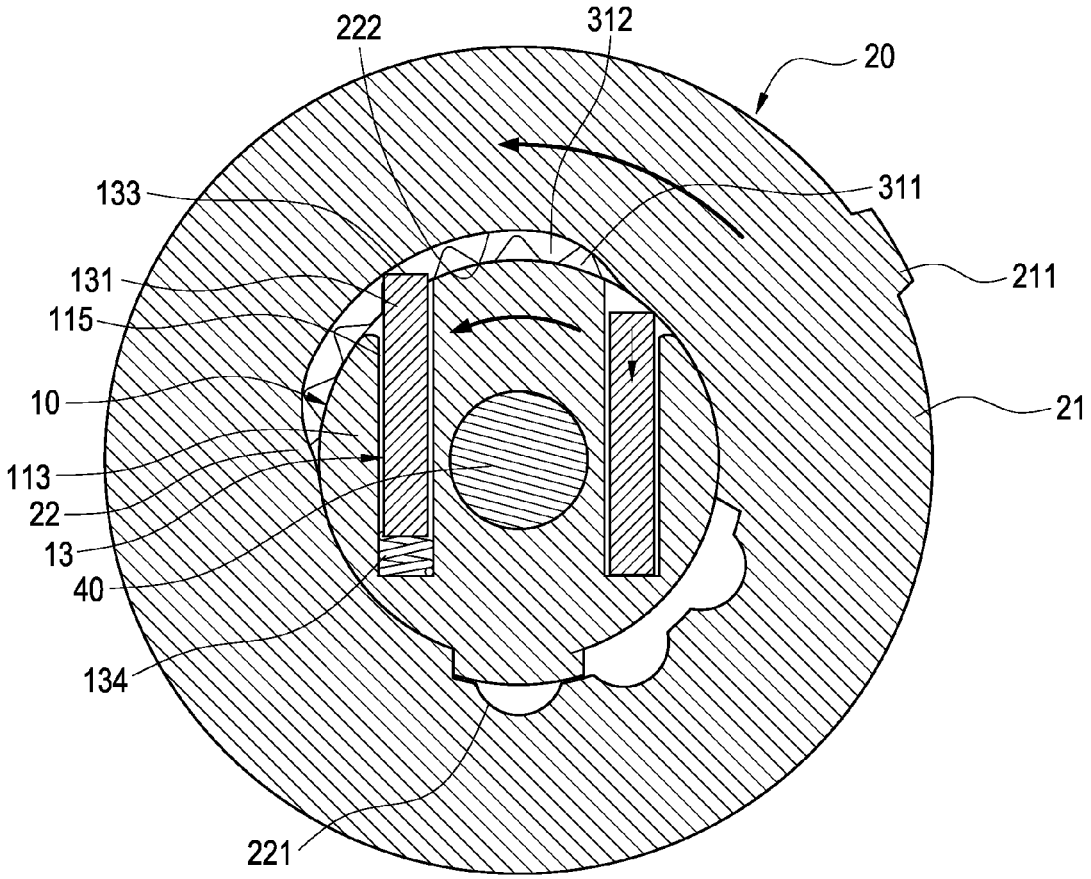
FIG. 9 is another cross sectional view showing the operation status after the adjustment ring being rotated counterclockwise according to the present invention.

Please refer from FIG. 7 to FIG. 10, the ratchet driving mechanism provided by the present invention is combined with a handgrip 8 for forming a hand tool. According to this embodiment, the hand tool is a screwdriver, but what shall be addressed is that the scope of the present invention is not limited by the hand tool only being the screwdriver. When a unidirectional operation is required according to actual needs, the adjustment ring 20 is firstly rotated counterclockwise thereby allowing the ball 121 of the position member 12 to be positioned in the cavity 221 defined at the left side (as shown in FIG. 8), at this moment the relation of the latch plate 131 defined at the left side and the adjustment ring 20 and the ratchet unit 30 is substantially the same as the relation disclosed in the first embodiment, the abutting block 133 of the latch plate 131 defined at the right side is removed from the accommodation slot 222 due to the rotation of the adjustment ring 20, meanwhile the latch plate 131 is forced to retract into the insertion slot 115 (as shown in FIG. 9).

Figure 10:
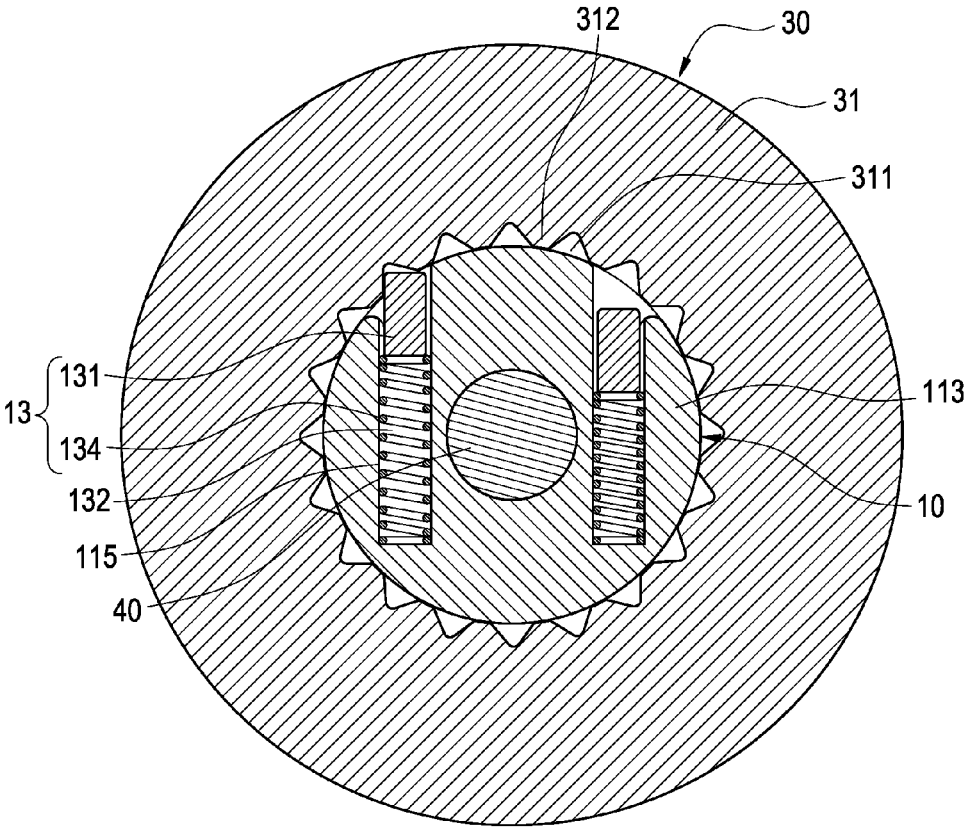
FIG. 10 is one another cross sectional view showing the operation status after the adjustment ring being rotated counterclockwise according to the present invention.

When the rotation segment 113 is rotated counterclockwise, the lower portion of the latch plate 131 defined at the left side is mutually latched with the ratchet teeth 312 (as shown in FIG. 10), thereby enabling the ratchet unit 30 to be driven for driving the screwdriver head to be operated counterclockwise; when the rotation segment 113 is rotated clockwise, the lower portion of the latch plate 131 defined at the left side is released from the ratchet teeth 312 thereby generating idle rotation. Because the rotating and positioning direction of the adjustment ring 20 is the same as the rotating direction in which the drive shaft 11 drives the ratchet unit 30, the ball 121 of the position member 12 is prevented from being released from the cavity 221, thereby being able to be precisely positioned on the rotation shaft 11.

Figure 11:
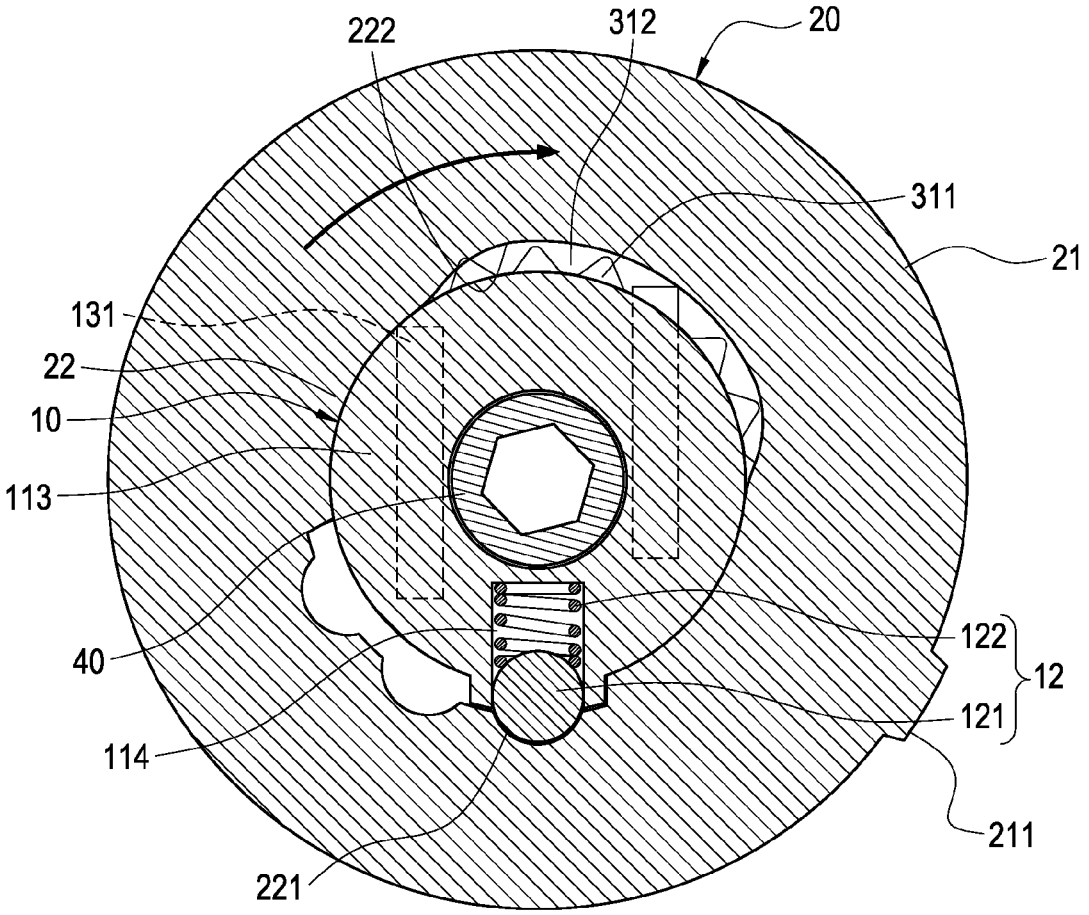
FIG. 11 is a cross sectional view showing the operation status after the adjustment ring being rotated clockwise according to the present invention.
Figure 12:
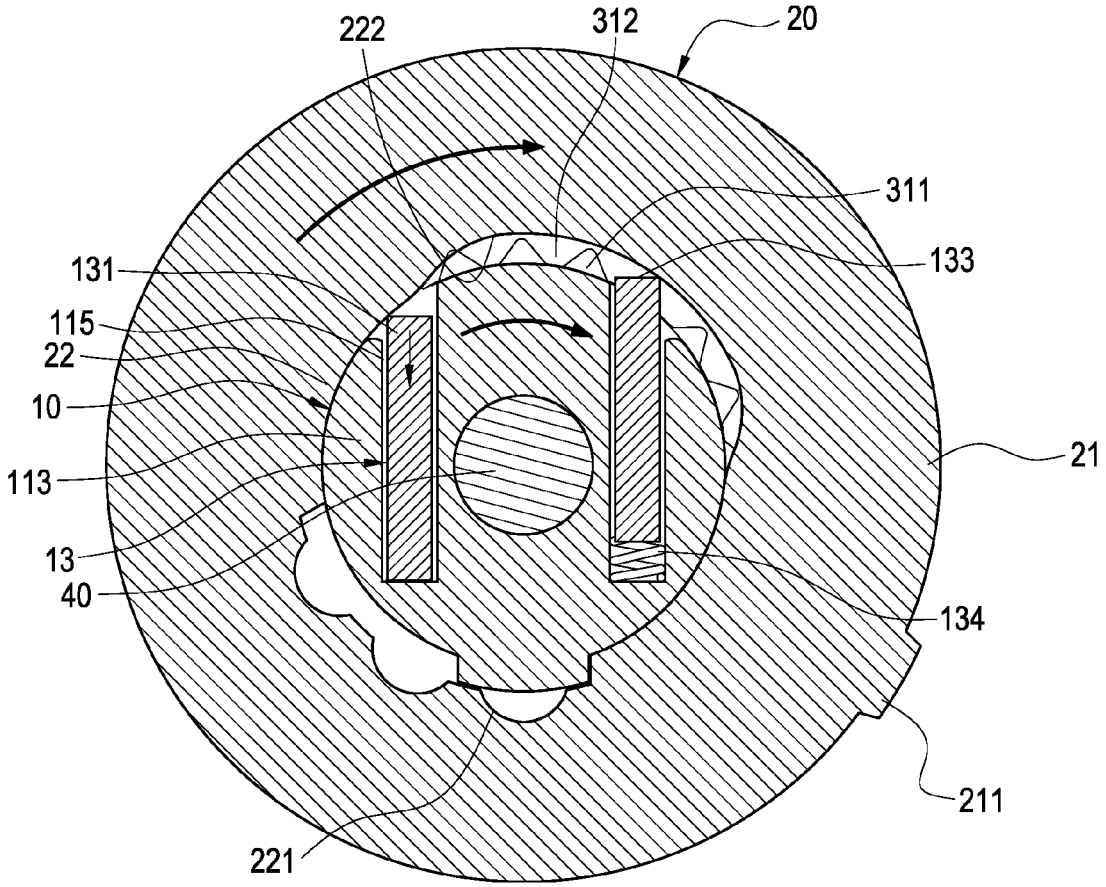
FIG. 12 is another cross sectional view showing the operation status after the adjustment ring being rotated clockwise according to the present invention.
Figure 13:
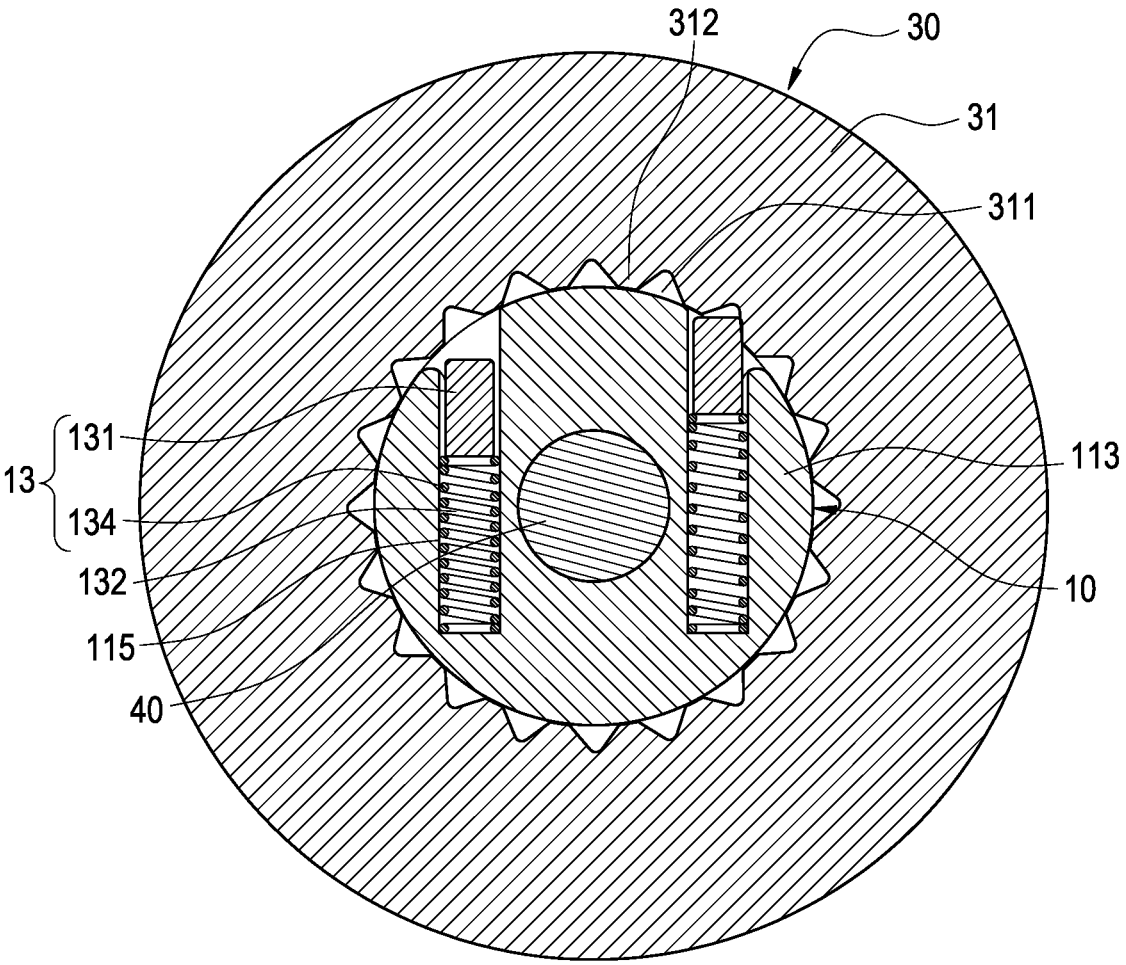
FIG. 13 is one another cross sectional view showing the operation status after the adjustment ring being rotated clockwise according to the present invention.

Please refer from FIG. 11 to FIG. 13, when the adjustment ring 20 is rotated counterclockwise, the ball 121 of the position member 12 is positioned in the cavity 221 defined at the right side (as shown in FIG. 11), at this moment the relation of the latch plate 131 defined at the right side and the adjustment ring 20 and the ratchet unit 30 is substantially the same as the relation disclosed in the first embodiment, the abutting block 133 of the latch plate 131 defined at the left side is removed from the accommodation slot 222 due to the rotation of the adjustment ring 20, meanwhile the latch plate 131 is forced to retract into the insertion slot 115 (as shown in FIG. 12).

When the rotation segment 113 is rotated clockwise, the lower portion of the latch plate 131 defined at the right side is mutually latched with the ratchet teeth 312 (as shown in FIG. 13), thereby enabling the ratchet unit 30 to be driven for driving the screwdriver head to be operated clockwise; when the rotation segment 113 is rotated counterclockwise, the lower portion of the latch plate 131 defined at the right side is released from the ratchet teeth 312 thereby generating idle rotation.

Based on what has been disclosed above, the ratchet driving mechanism for a hand tool provided by the present invention is novel and more practical in use comparing to prior art.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A ratchet driving mechanism for a hand tool, including:

a drive unit, including a drive shaft, a position member and two latch members, wherein the position member and each of the two latch members being installed on the drive shaft, and each of the two latch members including a latch plate and an elastic piece provided between the drive shaft and the latch plate, wherein each of the latch plates is protruded with an abutting block;

an adjustment ring, sleeved on the drive shaft corresponding to the position member and a portion of each of the two latch members, and formed with three cavities allowing the position member to be selectively latched and positioned and a single accommodation slot allowing each of the latch plates to inwardly/outwardly move;

a ratchet unit, sleeved on the drive shaft corresponding to another part of each of the two latch members, and formed with a plurality of ratchet teeth allowing each of the latch plates to be engaged, wherein the abutting blocks are both accommodated into the single accommodation slot when the position member is positioned in a middle cavity of the three cavities, and wherein one of the abutting blocks leaves the single accommodation slot from a left side thereof or the other one of the abutting blocks leaves the single accommodation slot from a right side thereof when the position member is positioned in a right or a left cavity which are adjacent to the middle cavity.

2. The ratchet driving mechanism for a hand tool according to claim 1, wherein the rotating and positioning direction of the adjustment ring is the same as the rotating direction in which the drive shaft drives the ratchet unit.

3. The ratchet driving mechanism for a hand tool according to claim 2, wherein the drive shaft is formed with a fasten segment and a rotation segment axially extended along the fasten segment, and the rotation segment is formed with an insertion slot allowing the latch member to be received.

4. The ratchet driving mechanism for a hand tool according to claim 3, wherein the position member includes a ball and a compress spring, the rotation segment is formed with a blind hole, and the ball and the compress ring are received in the blind hole.

5. The ratchet driving mechanism for a hand tool according to claim 4, wherein the adjustment ring is formed with an outer annular piece and an inner annular piece formed at the inner side of the outer annular piece, a surface of the outer annular piece is outwardly extended with a convex strip, the inner periphery of the inner annular piece is formed with a plurality of cavities, and each of the cavities allows the ball to be mounted and positioned therein.

6. The ratchet driving mechanism for a hand tool according to claim 2, wherein the latch plate is formed in a U-like shape, a groove is formed on the latch plate, and the elastic piece is received in the groove.

7. The ratchet driving mechanism for a hand tool according to claim 2, wherein the ratchet unit is formed with a head part and a neck part axially extended from the head part, the head part is formed with a central hole, and each of the ratchet teeth is annularly formed on the inner wall of the central hole.

8. The ratchet driving mechanism for a hand tool according to claim 7, wherein the center of the neck part is formed with a hexagonal insertion hole.

9. The ratchet driving mechanism for a hand tool according to claim 2, further including a screw unit which passes the drive unit so as to be combined with the ratchet unit.

* * * * *